US005545000A

United States Patent [19]

Gorsky

[11] Patent Number: 5,545,000

[45] Date of Patent: Aug. 13, 1996

[54] AUTOMATIC EJECT FINGER RETRACTOR FOR DOCUMENT SET EJECT SYSTEM

[75] Inventor: John T. Gorsky, Fairport, N.Y.

[73] Assignee: Xerox Corporation, Stamford, Conn.

[21] Appl. No.: 562,546

[22] Filed: Nov. 20, 1995

[51] Int. Cl.[6] ..... B65H 31/28

[52] U.S. Cl. ..... 414/790.3; 198/730; 414/790.7

[58] Field of Search ..... 198/728, 730; 271/222, 220; 414/790.3, 790.7; 355/322

[56] References Cited

U.S. PATENT DOCUMENTS

| | | | |
|---|---|---|---|
| 3,182,537 | 5/1965 | Grody | 414/790.3 X |
| 3,245,518 | 4/1966 | Reibel et al. | 198/730 X |
| 4,541,626 | 9/1985 | Millen | 271/236 |
| 4,826,383 | 5/1989 | Millen | 414/789.9 |
| 4,989,854 | 2/1991 | McNamara | 271/3.1 |
| 5,000,657 | 3/1991 | Gunther, Jr. | 414/790.3 |

*Primary Examiner*—Karen B. Merritt
*Assistant Examiner*—Janice L. Krizek
*Attorney, Agent, or Firm*—Denis A. Robitaille

[57] ABSTRACT

An automatic retractor system for retracting a finger element extending from a transport belt, as for example, in a document set compiler and eject apparatus, including a belt transport system having ejector fingers extending therefrom for assisting in the transport of the document set from a compiler tray to an output tray. In particular, the automatic retractor includes a restraint arm coupled between the transport belt and the free end of the eject finger for pulling back on the finger as the belt travels over the circumference of a roll member defining the path of travel of the transport belt.

6 Claims, 5 Drawing Sheets

AUTOMATIC EJECT FINGER RETRACTOR FOR DOCUMENT SET EJECT SYSTEM

The present invention relates to a compiler tray for use in a high speed printing machine, and, more particularly, concerns a motor driven belt transport system including an eject finger for assisting in the delivery of document sets to an output tray.

In a typical high speed electrostatographic printing machine, output copy sheets are accumulated into a stack in a compiler tray for creating a document set including a plurality of output copy sheets which can be delivered in unison to an output tray. The output copy sheets are accumulated and aligned in registration with one another in the compiler tray, situated atop a pair of stationary transport belts which are periodically driven through a transport cycle. In operation, when a sufficient number of output copy sheets have been collected, as may be indicated by an output count equaling a predetermined number, a motor is activated for setting the transport belts into motion to deliver the document set to the output tray.

The compiler tray is typically utilized for compiling or stacking sheets fed serially thereto into registration with one another so as to provide a neatly organized document set having uniformly aligned edges. The sheets may be registered against a single registration edge or dual registration edges for providing both lateral and longitudinal alignment with respect to the direction of travel of the sheets. It is also desirable to transport or eject a compiled document set from the compiler tray to an output tray for further processing or for retrieval by an operator. Rapid ejection of the document set from the compiler tray is desirable to avoid interrupting the delivery of subsequent sheets thereto. In addition, it is important to prevent disturbance to the document set during the ejection process, in order to eliminate the possibility of unintentionally induced misalignment of the previously registered document set.

The present invention is particularly concerned with a sheet compiler and document set eject system in which a stack of sheets is compiled into a document set which, in turn, is transported from the compiler tray to an output tray or other storage location. In particular, this invention relates to a mechanism for enhancing the set transport process, wherein a document set is transported on a transport belt having a finger element extending from a surface thereof for contacting the trail edge of the set during the transport cycle. A restraint arm is also provided, connected between the finger element and the belt surface for retracting the finger element to prevent interference between the trail edge of the document set and the finger element as the document set is transported out of the compiler tray.

Various approaches to sheet compilation and document set transport have been proposed and utilized in the art. The following disclosures may be relevant to various aspects of the present invention:

U.S. Pat. No. 4,826,383

Patentee: Millen

Issued: May 2, 1989

U.S. Pat. No. 4,989,854

Patentee: McNamara

Issued: Feb. 5, 1991

U.S. patent Ser. No. 08/429,383

Inventor: Rathbun

Filed: Apr. 26, 1995

U.S. patent Ser. No. 08/458,043

Inventor: Hawley et al.

Filed: Jun. 1, 1995

The relevant portions of the foregoing disclosures may be briefly summarized as follows:

U.S. Pat. No. 4,826,383 discloses a sheet mechanism having drive means for removing compiled sheet sets therefrom, wherein sheets are compiled in a tray against a registration edge and a completed set is ejected with the registration members being retracted by an eject mechanism comprising a continuously rotating drive roller projecting through a base of a tray and a coacting idler roller mounted on a spring arm which is retracted during stacking and then pressed against the top of the completed set to effect ejection. Preferably, the drive roller is a deformable roller having a low coefficient of friction surface.

U.S. Pat. No. 4,989,854 discloses a document set delivery apparatus wherein a set of copy sheets deposited on a surface is delivered positively to an output by engaging the trail edge of the set with at least two hook ended projections intended to overlie the top sheet. When the projections are driven in unison, as by a common belt, the hooks prevent the beam strength of the set from lifting the trail edge of the set out of contact with the projections.

U.S. patent application Ser. No. 08/429,383 discloses a home positioning system for use in combination with a DC motor driven system, wherein the DC motor is provided with a pulsed input voltage signal to effectively decelerate the motor. The home positioning system is disclosed in combination with a compiler tray of the type utilized in high speed printing systems such as an electrostatographic printing machine, wherein a projection extending from a transport belt can be precisely positioned at a home position in preparation for successive transport cycles.

U.S. patent application Ser. No. 08/458,043 discloses a document set compiler and eject apparatus including a belt transport system as well as an output roll system, wherein the belt and rolls of each respective system operate in conjunction with one another to provide smooth and effective transport of the document set from a compiler tray to an output tray. In particular, the output rolls, located downstream from the belt, are driven at a speed substantially greater than the speed of the transport belts for actively removing the document set from the belts to prevent damage to the trail edge thereof. The compiler tray also includes a retard roll system for maintaining the registration of the document set as it is transferred from the transport belts to the output rolls.

In accordance with one aspect of the present invention, a compiler tray for accumulating a plurality of output copy sheets delivered to a support surface thereof is provided to produce a document set, wherein means for transporting the document set from the compiler tray to an output tray comprise: a transport belt system including at least one movable belt for being selectively driven along a curvilinear path defined by a pair of rotatable roll members, the belt having a portion situated along a substantially common plane with the support surface; an eject finger extending from the belt for contacting the document set along the trail edge of the document set as the belt travels along the curvilinear path defined by the pair of rotatable roll members; and a restraint arm coupled between the belt and the eject finger for exerting a force on the eject finger in a direction toward a point of contact between the belt and the restraint arm.

In accordance with yet another aspect of the present invention, an electrostatographic printing machine including a document set delivery apparatus is provided, wherein a compiler tray for accumulating a plurality of output copy sheets delivered to a support surface thereof to produce a document set, having means for transporting the document set from the compiler tray to an output tray comprises: a transport belt system including at least one movable belt for being selectively driven along a curvilinear path defined by a pair of rotatable roll members, the belt having a portion situated along a substantially common plane with the support surface; an eject finger extending from the belt for contacting the document set along the trail edge of the document set as the belt travels along the curvilinear path defined by the pair of rotatable roll members; and a restraint arm coupled between the belt and the eject finger for exerting a force on the eject finger in a direction toward a point of contact between the belt and the restraint arm.

These and other aspects of the present invention will become apparent from the following description in conjunction with the accompanying drawings, wherein like reference numerals have been used throughout the drawings to designate identical elements therein. In the drawings.

While the present invention will be described with reference to a preferred embodiment thereof, it will be understood that the invention is not limited to this preferred embodiment. On the contrary, it is intended that the present invention cover all alternatives, modifications, and equivalents as may be included within the spirit and scope of the invention as defined by the appended claims.

Figure 1:
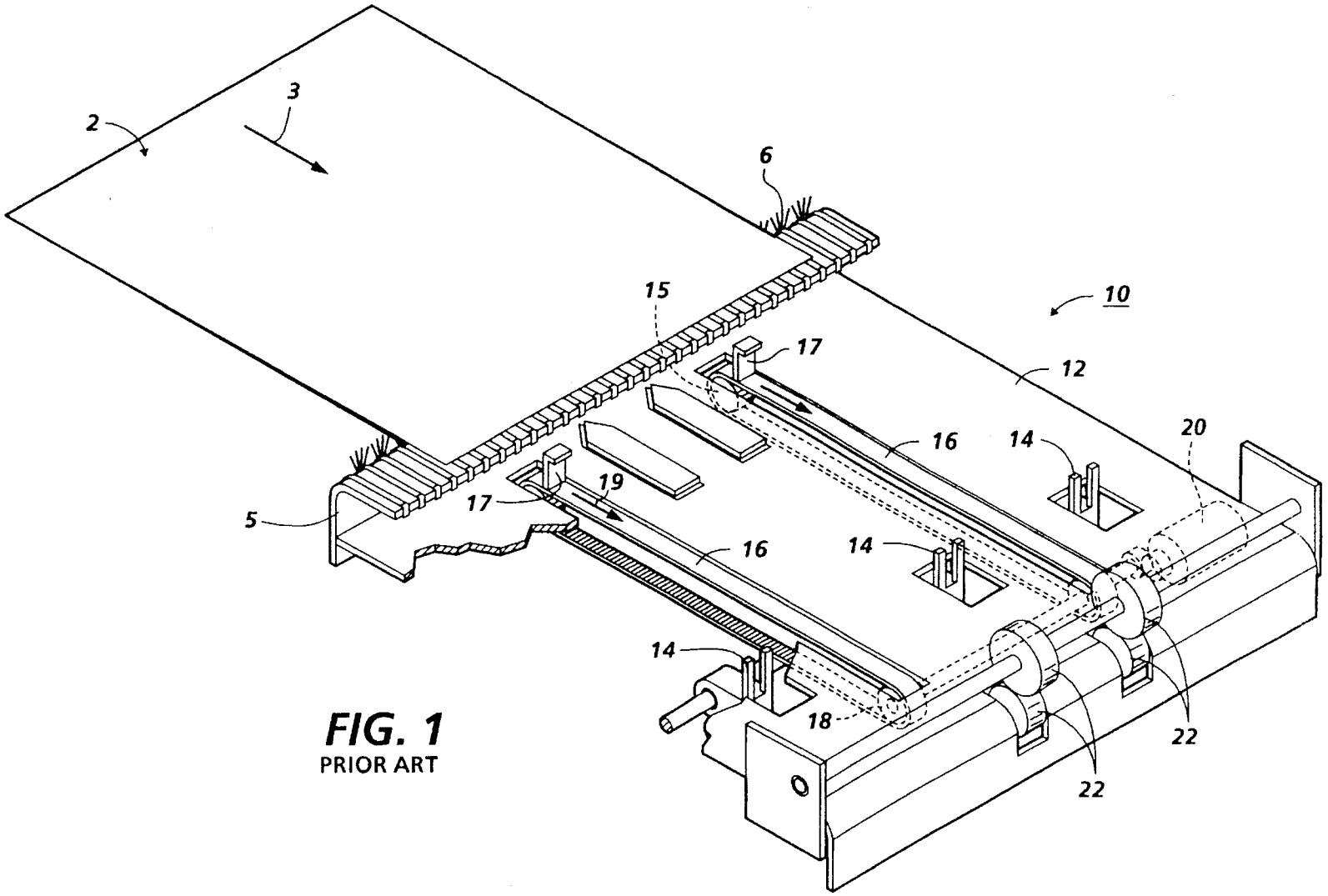
FIG. 1 PRIOR ART
FIG. 1 is a cut away perspective view of the compiler tray and document eject system of the present invention.
Figure 2:
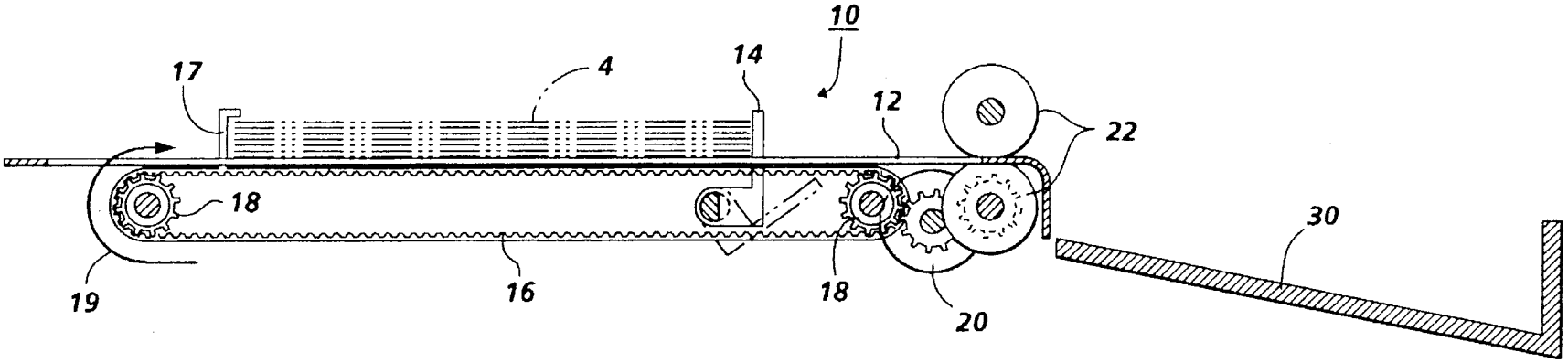
FIG. 2 PRIOR ART
FIG. 2 is an elevational side view of the compiler tray and set eject system shown in FIG. 1.

Referring to FIGS. 1 and 2, there is shown a compiler tray 10 of the type specifically designed to be incorporated into an automatic electrostatographic printing machine for accumulating and aligning a plurality of individual output copy sheets to produce a document print set 4. It is noted that,although the present invention is particularly well suited for use in an automatic electrostatographic printing apparatus, this invention is equally well adapted for use with various types of printing machines and/or other systems which require the compilation of sheets of material and the subsequent transport of such compiled materials.

As can be seen from FIGS. 1 and 2, an output copy sheet 2 is delivered to the compiler tray 10 through the transport motion of the sheet 2 in the direction of arrow 3. Initially, the sheet travels over an inlet member 5 having a plurality of fibers 6 extending therefrom for contacting the underside of the sheet 2 for removing static charges which may have accumulated on the sheet 2 during the transport thereof and for cleaning particles of dust and other contaminants from the surface thereof.

After traveling over the inlet member 5, the sheet is delivered to a rigid support surface 12 of the compiler tray 10, coming to rest on a pair of transport belts 16. Each transport belt 16 extends along a curvilinear path defined by a drive roll 18 and a journal roll 15, each being positioned such that a portion of the transport belt 16 is situated in a plane substantially common with the rigid support surface 12, located along an opening therein. The copy sheets 2 deposited in the tray 10 are placed in abutment with a registration edge which may include a displaceable registration fence comprising at least two pivotable registration members 14 sufficiently spaced apart to receive A4 and similar size paper. A third registration member may also be provided, as illustrated in FIG. 1, to assist in locating output copy sheets of greater dimensions. In addition, a corner registration apparatus (not shown) may be provided for urging the output copy sheets delivered to the compiler tray to be positioned in abutment with the registration fence. One exemplary embodiment of a suitable corner registration apparatus is disclosed in U.S. Pat. No. 4,541,626, wherein a wiper assembly is provided, having a plurality of blades arranged to wipe against the output copy sheets in the compiler tray, for urging the sheets into corner registration.

In operation, individual output copy sheets 2 are directed, in seriatim, into the compiler tray 10, with the support surface 12 and transport belts 16 operating as a temporary depository for collecting and accumulating a plurality of copy sheets making up a particular document set 4. After the document set 4 has been created, as may be determined, for example, by a comparison of the number of copy sheets delivered to the compiler tray 10 and the number of sheets in an original document set being copied, it is generally desirable to transport the document set 4 to an output tray 30 where the document set may be stapled or otherwise bound for further processing or retrieval. It will be understood that the document set could alternatively be stapled or otherwise bound in the compiler tray prior to transport to the output tray. As previously noted, a registration fence is also provided, as illustrated in phantom in FIG. 2, wherein registration members 14 making up the registration fence may be pivoted to permit transport of the document set 4 into a collection tray 30 or other suitable collection device such as a set stacker which may include an elevating mechanism (not shown) which provides increased sheet capacity to allow for the collection of multiple document sets.

In the compiler tray of the present invention, transport or ejection of the document set 4 from the compiler tray 10 is effected via a belt drive system including transport belts 16. Describing this belt drive system in greater detail, each transport belt 16 is engaged with a drive roller 18 which are further coupled to a motor 20, whereby the motor 20 is selectively energized to drive the transport belts 16 in a clockwise direction as viewed in the drawing and indicated by arrow 19. In addition, each eject transport belt 16 is provided with a belt eject finger 17 in the form of a tab element projecting substantially perpendicularly from the exposed surface of the belt 16 for assisting in the document set transport process. In operation, belts 16 are adapted to initially remain stationary for a selected period to accumulate a stack of output copy sheets in the compiler tray 10. At the start of a set eject cycle, motor 20 is energized such that the eject transport belts 16 are driven along the path of travel between rolls 15 and 18. Correspondingly, each eject finger 17 is transported into contact with the trail edge of the document set 4 while the registration fence is pivoted away from the support surface 12 of the compiler tray 10 as depicted in phantom in FIG. 2, allowing the document set 4 to be transported under the influence of belts 16 traveling in the direction of the output tray 30. A pair of output rollers 22 may also be provided for assisting the transfer of the document set 4 from the compiler tray 10 to the output tray 30, as shown in the FIGs.

Figure 3:
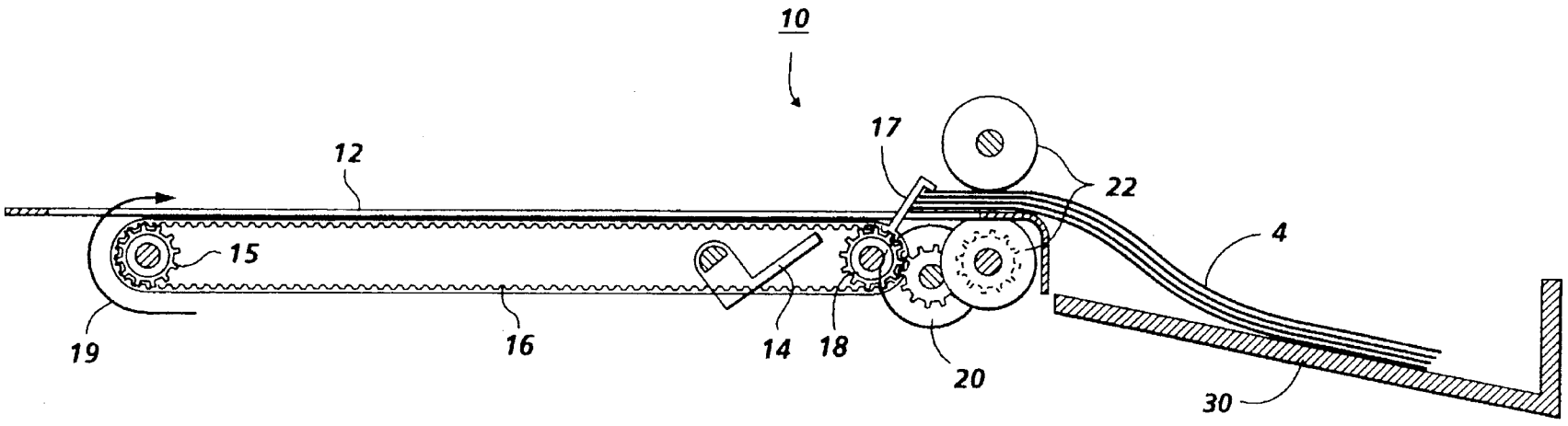
FIG. 3 is an elevational side view of the compiler tray and set eject system shown in FIG. 2, depicting the problem to which the present invention is directed.

In the case of the belt transport system described hereinabove, it is very important that the eject fingers 17 must not bind or otherwise become entangled or interfere with the trail edge of the document set 4 as the document set 4 is ejected from the compiler tray 10 and delivered to the output tray 30. For example, as depicted in FIG. 3, it is not uncommon for the eject finger 17 to catch onto the trail edge of a document set 4 as the document set 4 is transferred to the output tray 30, due to the height of the eject finger 17 and the relative motion thereof with respect to the document set 4. If the tab 17 becomes undesirably snagged or hooked to the trail edge, the alignment of the copy sheets making up the document set may be distorted, and, in the worst case, the belt drive system may become interrupted and/or be caused to stall. Thus, as shown in FIG. 3. the continued transport motion of the eject fingers 17 may tend to cause unacceptable damage to the alignment of the document set 4 along the trail edge thereof as the eject fingers 17 strike the trail edge of the document set while traveling around the circumference of the drive roll 18, prior to the complete transfer of the document set 4 from the compiler tray 10 to the output tray 30. It will be recognized that the inherent beam stiffness of the document set 4 will tend to lift the trail edge away from the surface 12 of the compiler tray 10, which may exacerbate the effects of interference between the trail edge and the eject finger 17.

Figure 4:
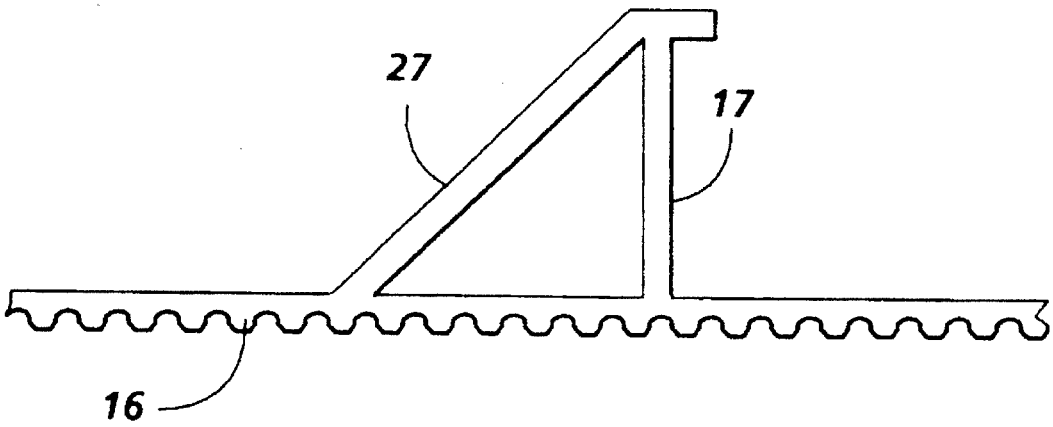
FIG. 4 is an enlarged elevational side view of a belt including a belt tab and the automatic retractor of the present invention.

The present invention is directed toward the problem described hereinabove by providing a means for automatically retracting the eject finger 17 away from the document set 4 as the document set is being transferred from the compiler tray 10 to the output tray 30. The invention is depicted in its simplest form in FIG. 4, wherein a restraint arm 27 is coupled between the transport belt 16 and the eject finger 17 so as to create a physical connection between the belt 16 and the free end of the eject finger 17. The restraint arm 27 is preferably fabricated from a nonextendable material for maintaining a fixed dimension between the belt 16 and the finger 17 at the points of contact with the restraint arm 27.

Figure 5:
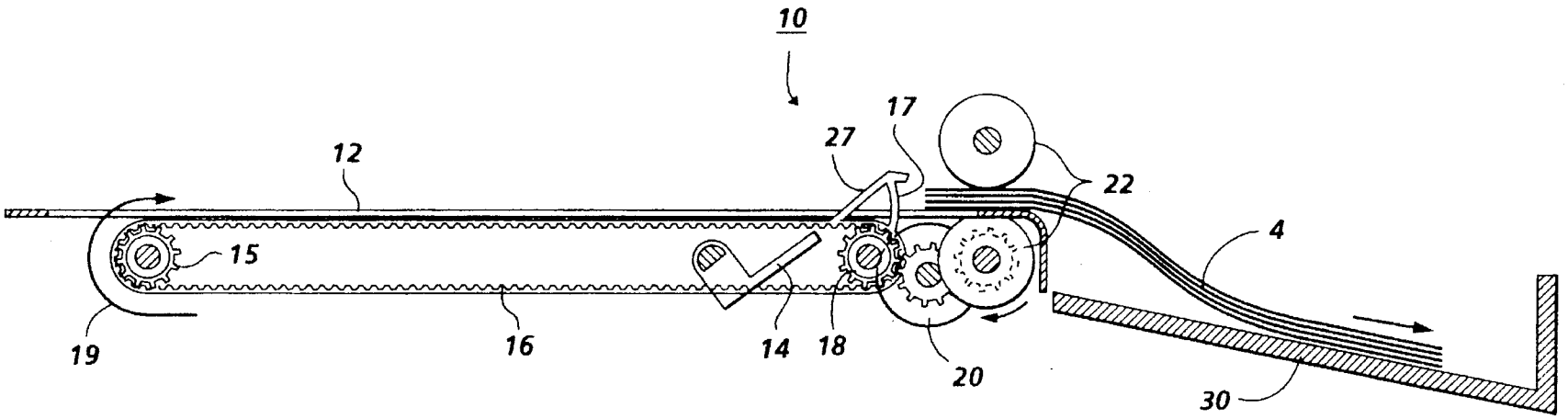
FIG. 5 is an elevational side view of the compiler tray and set eject system depicting the operation of the automatic belt tab retractor of the present invention.

The functionality of the restraint arm 27 is shown in FIG. 5, wherein it can be seen that the restraint arm 27 is operative to exert a force on the eject finger 17 at the point of contact therewith and in the direction of the point of contact between the belt 16 and the opposite end of the restraint arm 27. This force pulls the eject finger 17 backwards toward the belt 16 surface as the belt travels around the circumference of roll 18 while traveling along the curvilinear path of travel defined thereby. By pulling the eject finger 17 back toward the belt 16, the restraint arm 27 forces the eject finger 17 to be shifted from its substantially perpendicular relationship with the belt 16 to an angular relationship therewith, such that the finger is automatically retracted from the trail edge of the document set 4, as shown in FIG. 5. The automatic retraction of the finger 17 eliminates the possibility of interference between the finger 17 and the trail edge of the document set 4, thereby providing a solution to the problem described hereinabove.

In review, the document set compiler and eject system of the present invention includes a belt transport system having an eject finger for assisting the belt transport system, and also includes an automatic eject finger retractor for eliminating interference between the eject finger and the document set being transported to provide smooth and effective transfer of the document set from the compiler tray to an output tray. More specifically, the automatic retractor feature of the present invention includes a restraint arm coupled between the transport belt and the free end of the eject finger for pulling back the eject finger as the transport belt travels over a drive roll defining the curvilinear path of travel thereof.

It is, therefore, evident that there has been provided, in accordance with the present invention, an automatic retractor for use in a belt drive system of a document set compiler that fully satisfies the aspects of the invention as previously set forth. While the invention has been described in conjunction with a preferred embodiment thereof, it is evident that many alternatives, modifications, and variations will be apparent to those skilled in the art. Accordingly, the present application is intended to embrace all such alternatives modifications and variations as are within the broad scope and spirit of the appended claims.

I claim:

1. A compiler tray for accumulating a plurality of output copy sheets delivered to a support surface to produce a document set, including means for transporting the document set to an output tray, comprising:

a transport belt system including at least one movable belt for being selectively driven along a curvilinear path defined by a pair of rotatable roll members, said belt having a portion situated along a substantially common plane with the support surface;

an eject finger extending from said belt for contacting the document set along a trail edge thereof as the belt travels along the curvilinear path defined by the pair of rotatable roll members; and a restraint arm coupled between said belt and said eject finger for exerting a force on said eject finger in a direction toward a point of contact between said belt and said restraint arm.

2. The compiler tray of claim 1, further including drive means coupled to said belt for providing transport movement thereto, wherein said belt is adapted to remain stationary for a selected time to accumulate the plurality of output copy sheets to create the document set on the support surface, said belt being further adapted to be selectively driven by said drive means for effecting transport motion of said document set to the output tray.

3. The compiler tray of claim 2, further including a registration fence comprising a pivotable registration finger for aligning the plurality of output copy sheets on the support surface, said pivotable registration fingers being mounted for rotation about an axis so as to allow the document set to be transported from the support surface under influence of the transport movement of said belt.

4. An electrostatographic printing machine including a document set delivery apparatus for transporting a document set from a support surface to an output tray, said document set delivery apparatus, comprising:

a transport belt system including at least one movable belt for being selectively driven along a curvilinear path defined by a pair of rotatable roll members, said belt having a portion situated along a substantially common plane with the support surface;

an eject finger extending from said belt for contacting the document set along a trail edge thereof as the belt travels along the curvilinear path defined by the pair of rotatable roll members; and a restraint arm coupled between said belt and said eject finger for exerting a force on said eject finger in a direction toward a point of contact between said belt and said restraint arm.

5. The electrostatographic printing machine of claim 4, further including drive means coupled to said belt for providing transport movement thereto, wherein said belt is adapted to remain stationary for a selected period to accumulate the plurality of output copy sheets on the support surface to create the document set, said belt being further adapted to be selectively driven by said drive means for effecting transport motion of said document set.

6. The electrostatographic printing machine of claim 5, further including a registration fence comprising a pivotable registration finger for aligning the plurality of output copy sheets on the support surface, said pivotable registration finger being mounted for rotation about an axis so as to allow the document set to be transported from the support surface under influence of the transport movement of said belt.

* * * * *